United States Patent [19]

Hehl et al.

[11] 4,068,345

[45] Jan. 17, 1978

[54] SHOWER CURTAIN ROD ASSEMBLY

[75] Inventors: Klaus Hehl, Remscheid-Luttringhausen; Heike Schrankel, Wuppertal, both of Germany

[73] Assignee: Riloga-Werk Julius Schmidt, Remscheid, Germany

[21] Appl. No.: 731,345

[22] Filed: Oct. 12, 1976

[30] Foreign Application Priority Data

Oct. 16, 1975 Germany ..... 2546326

[51] Int. Cl.[2] ..... A47H 1/04; A47H 1/44

[52] U.S. Cl. ..... 16/94 D; 16/87.4 R; 16/95 D

[58] Field of Search ..... 16/94 D, 94 R, 95 D, 16/95 R, 96 D, 96 R, 87.4 R, 93 D; 211/118, 123, 182; 160/345, 346; 248/225.1, 226.1, 230

[56] References Cited

U.S. PATENT DOCUMENTS

| | | | |
|---|---|---|---|
| 3,151,666 | 10/1964 | Ford | 16/87.4 R X |
| 3,436,047 | 4/1969 | Foltz | 16/94 D |
| 3,441,147 | 4/1969 | Kelley | 211/123 X |
| 3,854,165 | 12/1974 | Haley | 16/94 R |

FOREIGN PATENT DOCUMENTS

| | | | |
|---|---|---|---|
| 672,110 | 10/1963 | Canada | 16/87.4 R |
| 2,053,447 | 5/1972 | Germany | 211/118 |
| 607,257 | 8/1948 | United Kingdom | 16/95 R |
| 873,055 | 7/1961 | United Kingdom | 16/94 D |

*Primary Examiner*—Mervin Stein
*Attorney, Agent, or Firm*—Michael J. Striker

[57] ABSTRACT

A curtain rod assembly for a shower curtain comprises at least two rail sections of identical profile and each formed with an upwardly open longitudinally extending channel, a downwardly open longitudinally extending channel, and between these channels with an upwardly, downwardly, and laterally closed longitudinally extending passage. A coupling element has one half snugly longitudinally engaged in one of the ends of one of the passages and another half snugly longitudinally engaged in one of the ends of the other of the passages so as longitudinally to join these two sections. A plurality of shower-curtain hooks can slide along the downwardly open channel and a ceiling unit has a headpiece slidable along the upwardly open channel and an upwardly extending rod that is secured to the ceiling. Two wall mounting members are each secured to a wall and have a portion engaged snugly longitudinally in the other end of the passage of a respective rail. A valance strip of bendable material is engaged over the entire front side of both of the sections with its bent-over upper lip engaging over the upper edges of the rail sections and its bent-under lower lip engaging under the lower edges of these rails so as completely to cover them.

11 Claims, 9 Drawing Figures

FIG. 1
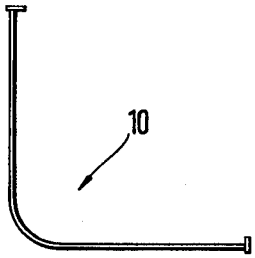
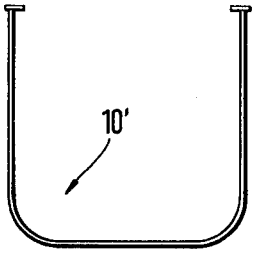
FIG. 2
FIG. 3a
FIG. 3b
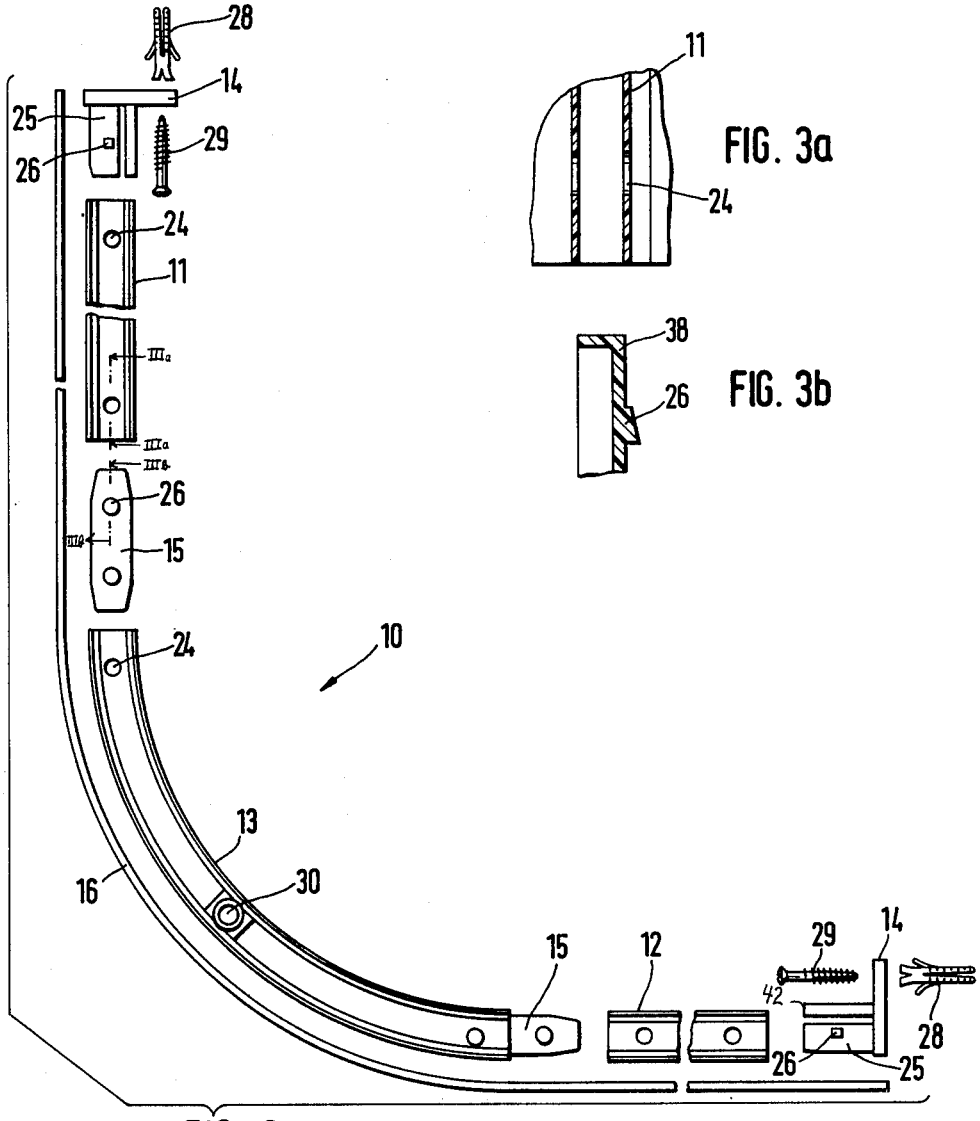
FIG. 3

SHOWER CURTAIN ROD ASSEMBLY

BACKGROUND OF THE INVENTION

The present invention relates to a curtain rod. More particularly this invention concerns a rod assembly for carrying a shower curtain or the like.

It is known to support a shower curtain on a stationary rod which is formed of a plurality of sections of like cross-sectional shape or profile. These sections are joined longitudinally by coupling elements normally secured in place by screws, and the ends of the rail thus formed are secured via other mounting elements to the wall. It is also frequently necessary to provide a strut that holds the rod relative to the ceiling. Such a strut is necessary when the shower rod is not straight, but is of L-shape so as to extend between two walls lying at a right angle to each other or even of C-shape wherein both ends of the rod are connected to the same wall.

Such assemblies are frequently rather unattractive in that the joints between the adjacent rail sections are plainly visible. Furthermore, the screws and the like which hold the assembly together are often exposed and, due to the wet environment which the assembly is used in, rust and present an unattractice appearance. Assembly of these arrangements is also relatively difficult, requiring some tools and mechanical skill. What is more it is frequently quite difficult to take such an arrangement apart once it has been assembled, as the screws and the like which hold the various elements together often freeze in place.

SUMMARY OF THE INVENTION

It is therefore an object of the present invention to provide an improved curtain rod.

Another object is the provision of an improved shower rod assembly.

Yet another object is to provide such an assembly which can be assembled and dissassembled with relative ease, and which presents an attractive appearance in use.

These objects are attained according to the present invention in a curtain rod comprising at least two elongated rail sections of like profile and each formed with a longitudinally extending upwardly open channel, with a longitudinally extending downwardly open channel, and between these channels with a longitudinally extending and upwardly, downwardly, and laterally closed passage having a pair of ends. Each section has at least one side having an upper longitudinally extending edge and a lower edge parallel thereto. A coupling element has one portion which is snugly longitudinally engaged in one of the ends of the passage of one of the rail sections and another portion engaged in one of the ends of the passage of another rail section longitudinally aligned with the first-mentioned section. A mounting element is engaged longitudinally snugly in the other end of one of the passages and is adapted to be secured to a fixed surface such as a wall. Finally a valance strip extends along and is secured to the sides of the rail so as substantially to cover these sides.

In accordance with this invention it is therefore possible to mount a succession of hooks in the lower, downwardly open channel and to support the shower rod on these hooks. The upwardly open channel serves for securing a ceiling-engaging strut, and the passage serves for joining the rail sections to each other and to the walls at the end. The valance strip, which is preferably made of synthetic-resin material with bent-over lips so as to be engageable over and under the upper and lower edges of the sides of the rail sections, completely covers the entire rail. This synthetic-resin valance strip can be decorated in any desirable manner and completely covers the rail sections which may also be made of synthetic resin material, but are preferably made of aluminum extrusions.

According to this invention the coupling elements are formed with laterally extending projections having bevel wedged ends which are engageable in corresponding holes formed in the sides of the passages. Thus it is possible to snap these coupling elements into the passages so as easily and quickly to join two such rail sections together. The mounting elements which are secured to the wall engage in the ends of the passages and may be formed so as to grip around the entire back side of the rail, having a C-section projection similar to the valance strip.

In accordance with this invention the ceiling strut includes a headpiece which is slidable along in the upwardly open channel of the rail sections and which has a pair of laterally deflectable upwardly extending arms whose ends are engageable in cutouts in a strut tube. The upper end of the strut tube is secured to the ceiling by means of another such headpiece which is simply screwed to the ceiling and held in place by means of a screw or the like.

Thus the system according to the present invention includes a plurality of rail sections, some of which may be straight and some of which may be curved so as to allow the arrangement to be adapted to any desired shape. Then for each ceiling strut there is a tube and a pair of like headpieces, one of which is fitted in the upper channel of the rail sections and the other of which is screwed to the ceiling. Like coupling elements join any desired number of rail sections together and the valance strip may be cut to any desirable length. This valance strip may be slid longitudinally over the joined rail sections or simply snapped in place. Only the securing of the mounting elements to the wall and ceilings requires some tools, as the rest of the arrangement can simply be snapped together by hand.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a top view of a shower-rod assembly in accordance with this invention;

FIG. 2 is a further shower-rod assembly in accordance with this invention;

FIG. 3 is an exploded top view of the assembly of FIG. 1;

FIGS. 3*a* and 3*b* are sections taken along line III*a*—III*a* and III*b*—III*b* of FIG. 3, respectively;

SPECIFIC DESCRIPTION OF PREFERRED EMBODIMENTS

As shown in FIG. 1 it is possible to mount the shower-rod assembly 10 according to this invention between a pair of walls lying at a right angle to each other, giving the assembly an L-shape. It is also possible as shown in FIG. 2 to use a C-shaped assembly 10' in which both ends of the rail or rod are attached to the same wall.

Figure 4:
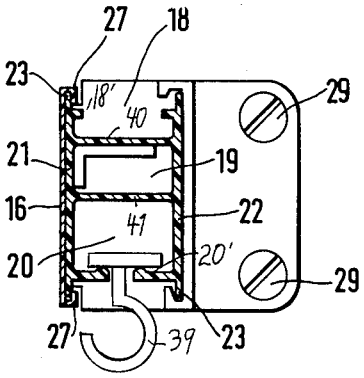
FIG. 4 is a cross section through an end of the assembly shown in FIG. 3.

FIG. 3 shows how the assembly 10 of FIG. 1 comprises two straight rail sections 11 and 12 joined by an elbow or circularly arcuate section 13. All of these sections 11–13 are of identical cross section as shown in FIG. 4. They are secured to the walls by wall mounts 14 and are joined longitudinally together by coupling elements 15. Furthermore a flexible valance strip 16 covers the entire front side of all of the sections 11–13. At at least one point the assembly is connected to the ceiling by means of a ceiling strut 17 shown in detail in FIGS. 5–7.

The rail 11 is formed of aluminum and, as shown in FIG. 4, has a pair of sides 21 and 22 interconnected by a pair of webs 40 and 41 so as to define an upwardly open channel 18, a downwardly open channel 20, and a longitudinally extending closed passage 19 between the channels 18 and 20. Shower hooks 39 are slidable along the lower downwardly open passage 20 which has a pair of inwardly extending lips 20' that prevent these hooks 39 from falling out. The upper passage 18 has a similar pair of lips 18' which similarly allow elements to slide along this channel 18 without pulling out. The sides 21 and 22 have upper and lower edges 23. Furthermore, the webs 40 and 41 are formed as shown in FIG. 3*a* adjacent the ends of the passages 19 with throughgoing holes 24 spaced a predetermined distance from the rail-section ends.

Each of the wall mounts 14 as shown in FIGS. 3 and 4 has a first projection 25 which engages in the passage 18, and a second portion 42 which engages around the back side 22 of the respective section. Screws 29 engaged in expansion sleeves 28 hold the element 14 tightly against the wall. Furthermore, the projection 25 is formed with laterally extending projections 26 with inclined end surfaces. These projections 26 engage in the holes 24 so as to hold the elements 11, 12 and 14 together.

The valance strip 16 is made of flexible synthetic-resin material and has upper and lower edges 27 and 28 which are bent over and under respectively so as to engage around the upper and lower edges 23 of the side 21. This strip 16 therefore can cover the entire front sides 21 of all of the sections 11–13 and present an attractive appearance. The strip 16 is slid along the assembled rail section before it is mounted in place or can even be snapped in place over it afterward.

The elements 15 as shown in FIG. 3*b* are not solid, but have walls 38 formed with projections 26 like the elements 14 so as to engage in the holes 24. Thus half of the element 15 is engaged longitudinally in one of the passages 19 and the other half in another passage 19 until the projections 26 snap in place so as to lock the assembly together.

Figure 5:
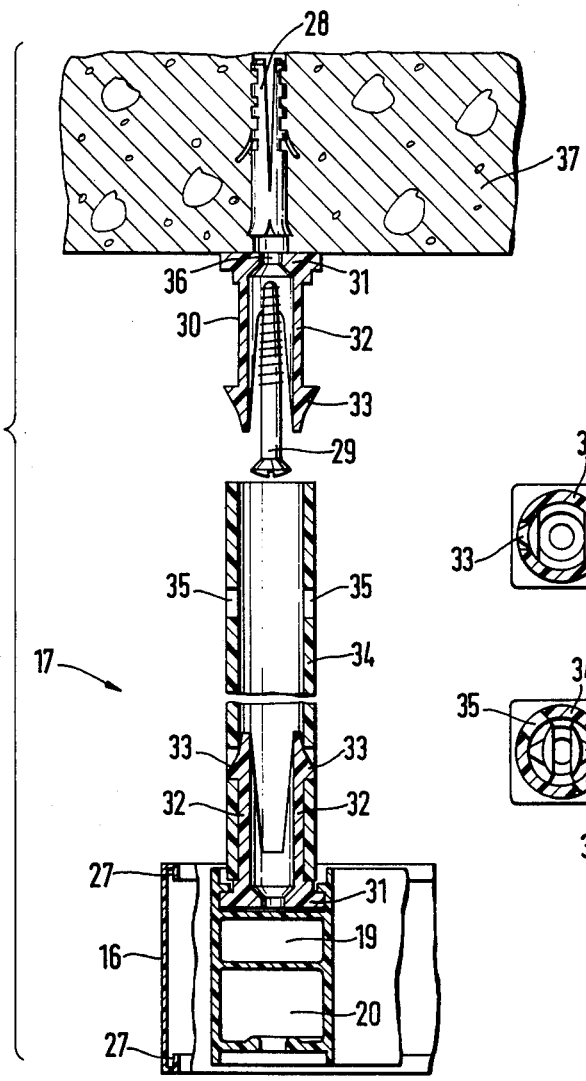
FIG. 5 is a vertical section through a ceiling strut assembly as shown in FIG. 3.
Figure 6:
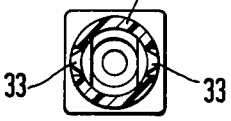
FIGS. 6 and 7 are horizontal sections through the assembly of FIG. 5 shown in two different positions.
Figure 7:
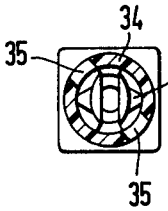

Finally each ceiling strut 17 as shown in FIGS. 5–7 comprises a pair of headpieces 31 of identical shape. The lower headpiece 31 is slidable along the upper channel 18 and engaged under the lips 18' thereof. It has a pair of upwardly extending arms 32 whose laterally extending ends 33 are engageable in laterally throughgoing holes 35 formed in a strut tube or rod 34. These ends 33 are of triangular section so that if the tube 34 is twisted from the position shown in FIG. 6 to the position shown in FIG. 7 the ends 33 are turned inwardly and the arrangement can be disassembled. The upper headpiece 31 is screwed to the ceiling 37 via a screw 29 engaged in an expansion sleeve 28.

In use the necessary elements 11, 12, and 13 are connected together by means of the necessary number of coupling elements 15. No tools are required for such assembly. Thereafter an end element 30 of a strut has its head 31 slid into the top channel 18, once again without use of tools, and two wall-mounting members 14 are each snapped into the two ends of the assembly. A valance strip 16 can then be mounted across the entire front of the arrangement in order to present the desired decorative appearance. Up to now it is not yet necessary to use any tools in the assembly of the arrangement. At this time the sleeves 28 are sunk in the appropriate places of the walls and in the ceiling 37. A screw 29 is then passed through a strut end element 30 at a hole 36 therein into the sleeve 28 in the ceiling and the wall-mounting members 14 are similarly screwed to the walls. A strut tube 34 is then pushed over the ceiling-mounted member 30 and the other member 30 on the rail assembly is fitted into each lower end. The tube 34 is then turned until the ends 33 lock in its holes 35 and the entire assembly is rigidly mounted in place.

In order to take the arrangement apart it is merely necessary to unscrew the five screws holding the entire arrangement in place. In order to pull the rail sections apart the valance strip 18 is slid off one end and the projections 26 are pushed into the holes 24 so as to allow the elements 15 and 14 to be pulled out of the passages 19. In this arrangement the sections 11–13 are all made of aluminum extrusions. The other parts of the assembly except for the screws 29 are all made of synthetic-resin material.

It will be understood that each of the elements described above, or two or more together, may also find a useful application in other types of curtain-rod assemblies differing from the types described above.

While the invention has been illustrated and described as embodied in a rod assembly for shower curtain, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A curtain rod comprising: at least two elongated rail sections of like profile and each formed with a longitudinally extending upwardly open channel, with a longitudinally extending downwardly open channel, and between the respective channels with a longitudinally extending and upwardly, downwardly, and laterally closed passage having a pair of ends, each section having at least one side having an upper longitudinally extending edge and a lower edge parallel thereto, one of said ends of one of said sections being longitudinally aligned with one of said ends of the other section; a coupling element having one portion snugly longitudinally engaged in one of said one ends and another portion snugly longitudinally engaged in the other of said one ends; a mounting element engaged longitudinally snugly in the other end of one of said passages and adapted to be secured to a fixed surface; and a valance strip extending along and secured to said sides of said rails and substantially covering said sides.

2. The curtain rod defined in claim 1 wherein said strip has an upper edge formed as a bent over lip engaging over said upper edges of said sides and a lower edge formed as a bent under lip engaging under said lower edges of said sides, said strip being of C-section.

3. The curtain rod defined in claim 2 wherein said strip is made of flexible synthetic-resin material.

4. The curtain rod defined in claim 1 wherein said sections are formed at said passages adjacent the ends thereof with laterally throughgoing holes, said coupling element being formed at its said portions with laterally extending projections engaging in said holes.

5. The curtain rod defined in claim 4 wherein said projections on each of said portions have end surfaces inclined away from the other portion.

6. The curtain rod defined in claim 1, further comprising a second mounting element extending transversely upwardly from said rail sections and having a pair of upwardly extending arms with laterally deflectable ends, and a third mounting element of tubular shape and having laterally opening holes, said ends of said arms engaging in said holes of said third mounting element.

7. The curtain rod defined in claim 6 wherein said second mounting element has a head shaped to fit into said upwardly open channel.

8. The curtain rod defined in claim 7 wherein said head is formed with a vertically throughgoing hole adapted to receive a screw.

9. The curtain rod defined in claim 1 wherein said mounting element has a projection engageable longitudinally in said other end of said passage and a laterally extending projection, said passages being formed at their said other ends with laterally extending holes for receiving said projections.

10. The curtain rod defined in claim 1 wherein said mounting element is formed as a single integral piece of synthetic-resin material.

11. A shower rod assembly comprising: at least two rail sections of identical profile and each formed with an upwardly open longitudinally extending channel, a downwardly open longitudinally extending channel, and between said channels an upwardly, downwardly, and laterally closed longitudinally extending passage having two ends, each section further having a pair of sides with upper and lower edges; a coupling element having one half snugly longitudinally engaged in one of said ends of one of said passages and another half snugly longitudinally engaged in one of said ends of the other of said passages, whereby said sections are longitudinally joined by said coupling element; a plurality of curtain hooks adapted to support a shower curtain slidable along said downwardly open channel; two wall mounting members each securable to a wall and having a portion engaged snugly longitudinally in the other end of the passage of a respective rail section; a ceiling mounting unit having a head piece slidable along said upwardly open channel and a rod extending upwardly from said head piece and adapted to be secured to a ceiling; and a valance strip of bendable material and having an upper bent-over lip engaging over said upper edges of one of said sides of both sections and a lower bent-under lip engaging under said lower edges of said one side of both sections, said strip extending longitudinally the full length of both of said sections and completely covering both of said one sides.

* * * * *